United States Patent [19]

Stambaugh

[11] 4,121,910

[45] Oct. 24, 1978

[54] TREATING CARBONACEOUS MATERIAL

[75] Inventor: Edgel P. Stambaugh, Worthington, Ohio

[73] Assignee: Battelle Memorial Institute, Columbus, Ohio

[21] Appl. No.: 816,397

[22] Filed: Jul. 18, 1977

[51] Int. Cl.[2] ..... C10L 9/10; C10G 1/00

[52] U.S. Cl. ..... 44/1 B; 208/8

[58] Field of Search ..... 44/1 R, 1 B; 201/17; 208/223–225, 8

[56] References Cited

U.S. PATENT DOCUMENTS

| | | | |
|---|---|---|---|
| 1,569,871 | 1/1926 | Morrell | 208/225 X |
| 1,868,333 | 7/1932 | Morrell et al. | 208/224 X |
| 2,400,515 | 5/1946 | Kent | 208/225 X |
| 3,284,343 | 11/1966 | Shirley et al. | 208/224 X |
| 3,719,587 | 3/1973 | Karchmer et al. | 208/224 X |
| 3,796,650 | 3/1974 | Urban | 208/10 |
| 3,993,455 | 11/1976 | Reggel et al. | 44/1 R |

*Primary Examiner*—Carl F. Dees

*Attorney, Agent, or Firm*—Philip M. Dunson

[57] ABSTRACT

A method of treating a solid carbonaceous material comprising essentially lignite or bituminous or subbituminous coal to provide therefrom finely dispersed solid particles substantially free of ash and sulfur, by mixing the solid material with a liquid aqueous alkaline solution comprising essentially a sodium, potassium, or ammonium hydroxide, hydrosulfide, or carbonate, or a plurality thereof; dissolving the material by heating the resulting mixture to a temperature in the range of about 125° C to the critical temperature, at a pressure of at least about 25 psig, while maintaining a substantial portion of the mixture in the liquid state; separating from the resulting solution any undissolved coal, ash, and other solids; reducing the pH of the solution to less than about 9 to precipitate therefrom a powder comprising the carbonaceous material, with a substantial proportion of the ash and sulfur that had been in the starting material now remaining in solution; and separating the precipitated powder from the solution. Typically either the pH of the solution is gradually reduced to less than about 2 during a time of at least about 5 minutes, or the precipitated powder is washed with an acid solution having a pH of less than about 2.

19 Claims, 1 Drawing Figure

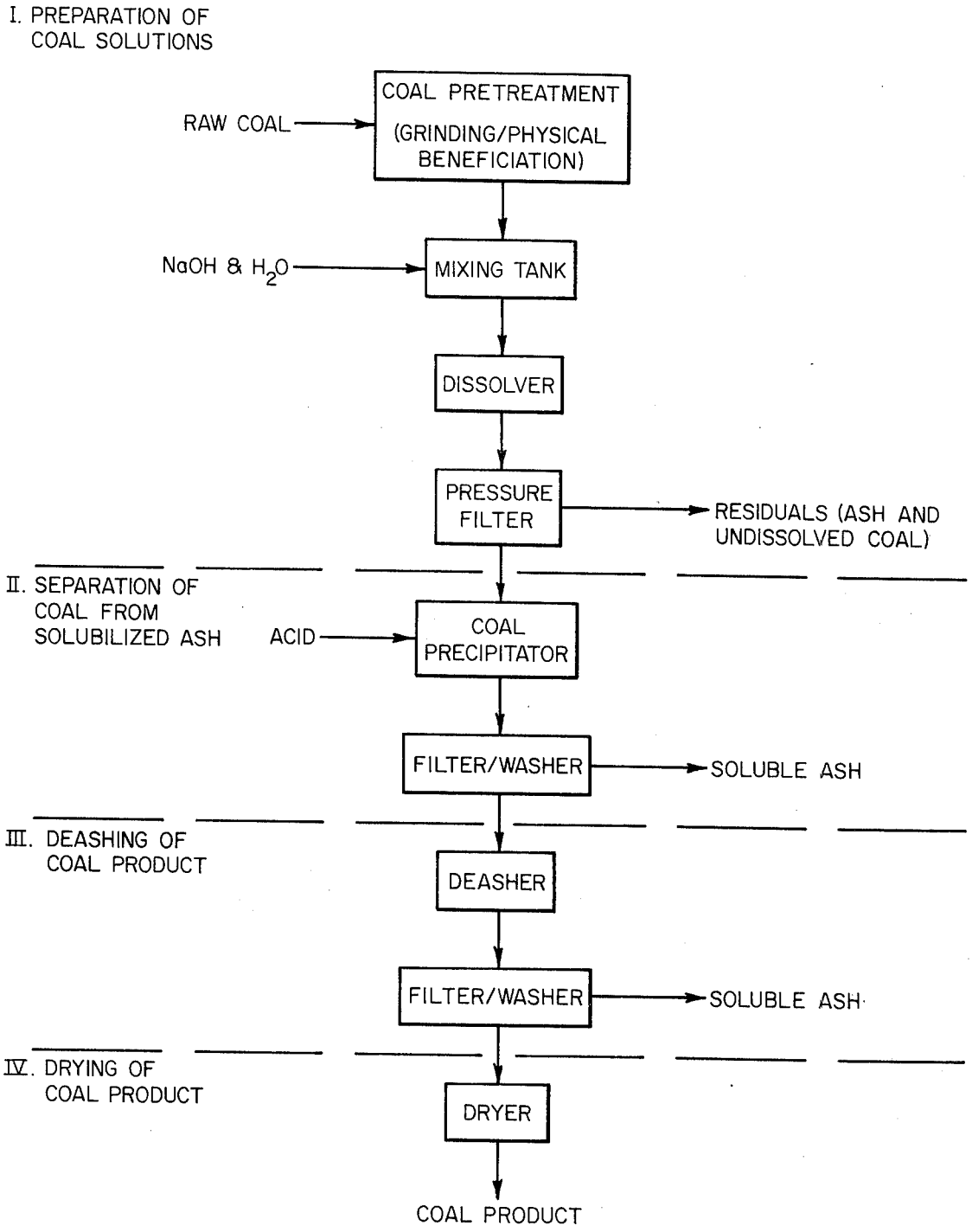
I. PREPARATION OF COAL SOLUTIONS
RAW COAL
COAL PRETREATMENT (GRINDING/PHYSICAL BENEFICIATION)
NaOH & $H_2O$
MIXING TANK
DISSOLVER
PRESSURE FILTER
RESIDUALS (ASH AND UNDISSOLVED COAL)
II. SEPARATION OF COAL FROM SOLUBILIZED ASH
ACID
COAL PRECIPITATOR
FILTER/WASHER
SOLUBLE ASH
III. DEASHING OF COAL PRODUCT
DEASHER
FILTER/WASHER
SOLUBLE ASH
IV. DRYING OF COAL PRODUCT
DRYER
COAL PRODUCT

TREATING CARBONACEOUS MATERIAL

BACKGROUND

Coal is the major source of fossil fuel resource in the United States. It has been estimated that the United States has enough coal to last about 600 years at the present rate of consumption, whereas the supply of petroleum is expected to last for only another 25 to 50 years.

The automotive industry is a large consumer of petroleum. If this industry is to continue after the world's supply of petroleum has been exhausted, it must convert to an alternate source of energy. One potential source of energy is coal, fired directly as a solid fuel or mixed with oil or gasoline and fired as a slurry.

While the use of coal could result in easing or ameliorating the problem, it is not without problems. All coals contain excessive amounts of sulfur and ash which must be reduced to low levels in order to prevent excessive corrosion and erosion of the engines and pollution of the atmosphere.

Therefore, one of the first problems to overcome in the utilization of coal as an alternate automotive fuel, and as a substitute for petroleum as source of energy in other applications, is to produce a coal having the desired purity.

The present invention comprises a method of treating a solid carboanceous material comprising essentially lignite or bituminous or subbituminous coal to provide therefrom finely dispersed particles that are substantially free of ash and sulfur. The particles have a variety of uses. For example, they may be dried to provide a powdered fuel usable in internal and external combustion engines, furnaces, or other combustion devices; they may be liquefied, or else mixed with carbonaceous liquid, to provide a liquid fuel that is similarly usable; or they may be compressed, either with or without a binder material, into solid pieces for use as briquets for burning in furnaces and other combustion devices or as electrodes.

DEFINITIONS

Hydrothermal — hydro (water) plus thermal (heat); thus, hydrothermal means the use of hot water to achieve a desired reaction. The major portion of the water is maintained in the liquid phase during the reaction.

Ash — the non-carbonaceous fraction of coal, consisting of inorganic materials.

MAF — moisture ash free basis.

Colstrip — refers to colstrip mine in Rosebud County, Montana.

SUMMARY

A typical method according to the present invention, for treating a solid carbonaceous material comprising essentially lignite or bituminous or subbituminous coal to provide therfrom finely dispersed solid particles substantially free of ash and sulfur, comprises mixing the solid material with a liquid aqueous alkaline solution comprising essentially a sodium, potassium, or ammonium hydroxide, hydrosulfide, or carbonate, or a plurality thereof; dissolving the material by heating the resulting mixture to a temperature in the range of about 125° C. to the critical temperature, at a pressure of at least about 25 psig, while maintaining a substantial portion of the mixture in the liquid state; separating from the resulting solution any undissolved coal, ash, and other solids; reducing the pH of the solution to less than about 9 to precipitate therefrom a powder comprising the carbonaceous material, with a substantial proportion of the ash and sulfur that had been in the starting material now remaining in solution; and separating the precipitated powder from the solution.

The undissolved coal, ash, and other solids typically are separated from the solution by filtering at elevated temperature and pressure. Silica may be precipitated from the solution by adding calcium oxide or calcium hydroxide thereto, before reducing the pH. Typically the temperature of the solution is about 25° to 150° C. during the pH reducing step.

The pH typically is reduced either by sparging the solution with carbon dioxide, or by adding an acid, such as formic, acetic, sulfuric, or hydrochloric acid, to the solution.

Typically, either the pH of the solution is gradually reduced to less than about 2 during a time of at least about 5 minutes; or, with the temperature of the solution about 60° to 80° C. during the pH reducing step, the method may comprise also washing the precipitated powder with an acid solution having a pH of less than about 2. The precipitated powder typically is washed with formic, acetic, sulfuric, or hydrochloric acid. Alternatively, the washing may comprise mixing the precipitated powder with water and sparging the resulting slurry with sulfur dioxide or sulfur trioxide. Or the precipitated powder may be washed by mixing it with water and heating the mixture to a temperature of about 175° to 275° C., at a pressure of at least about 75 psig that is provided in part by carbon monoxide or carbon monoxide and hydrogen.

The aqueous solution may comprise also sodium, potassium, or ammonium sulfide. The solution separated from the precipitated powder may be regenerated for recycling.

The method may comprise also either (a) drying the precipitated powder to provide a powdered fuel usable in combustion engines, furnaces, or other combustion devices; (b) mixing the precipitated powder with a carbonaceous liquid to provide a liquid fuel usable in combustion engines, furnaces, or other combustion devices; or (c) liquefying the precipitated powder by mixing with a liquid carbonaceous material; heating the mixing to a temperature in the range of about 250° C. to the critical temperature, at a pressure of at least about 100 psig, provide in part by carbon monoxide or carbon monoxide and hydrogen; and separating the liquid product from any unreacted solids; the liquid product providing a fuel usable in combustion engines, furnaces, or other combustion devices. The carbonaceous material may comprise essentially the separated liquid product recycled from earlier liquefaction of the precipitated powder as in (*c*).

The method may comprise also compressing the precipitated powder, either with or without a binder material, into pieces usable as briquets for burning in furnaces and other combustion devices or as electrodes.

DRAWING

The single FIGURE is a flow diagram illustrating typical steps in practicing the present invention.

DETAILED DESCRIPTION

A study was conducted to establish the technical feasibility of producing, by hydrothermal processing, a low-sulfur, low-ash coal which may be suitable as an alternate fuel for automotive engines.

Efforts were made to achieve the objectives by a reconstitution (reprecipitation) method employing hydrothermal processing. This entails the following processing steps:

(1) Preparation of coal solutions by pressure leaching. For example, a western coal in aqueous NaOH solutions to dissolve the majority of the coal, leaving most of the ash as the residue
(2) Separation of the dissolved coal from the coal solution by pH adjustment
(3) Separation of coprecipitated ash from the coal product by acid leaching
(4) Drying of the coal product to remove residual moisture.

By this combination of steps, coal products containing about 0.5 percent ach (MAF) and about 0.4 percent sulfur (MAF) were prepared from a Colstrip coal, a subbituminous western coal. The ash was found to be composed of, primarily, silica; the sulfur was probably in the form of organic sulfur. Heat content of the products ranged from 13,500 to 14,250 Btu/lb (MAF). The raw coal contained 12.3 percent ash (MAF) and 1.01 percent sulfur (MAF) and had a heat content of 12,300 Btu/lb (MAF).

The coal solutions were prepared by heating the coal in a 10 percent sodium hydroxide solution at temperatures ranging from 225° to 315° C. for 30 to 120 minutes. Coal dissolution ranged from 79 to 94 percent (MAF). Degree of ash dissolution ranged from 63 percent (MAF) at 270° C. to about 25 percent (MAF) at 225 and 315° C. Degree of sulfur dissolution was greater than 94 percent (MAF) at all temperatures.

The coal values were recovered from the coal solutions by neutralization with inorganic and organic acids at temperatures ranging from 25° to 80° C. Precipitation of the coal began at a pH of about 10 and appeared to be complete at a pH of about 8 to 9. It was desirable to carry out the stepwise neutralizations at temperatures of about 60° to 80° C. to destroy the thioxtropic nature of the resulting slurry.

Deashing of the coal products was achieved at pH values of about 1.5 to 2. Coal products containing 0.4 to 0.5 percent ash (MAF) were prepared both by a single-step process whereby the coal precipitation and deashing were achieved in one operation and by a two-step process whereby the coal was first precipitated with, for example, carbon dioxide, and then the coal product was deashed in a separate step.

Sulfur content of the coal product appeared to be more dependent on processing conditions used to prepare the coal solutions rather than on the conditions used to precipitate and deash the coal. Several coal products containing 0.34 to 0.44 percent (MAF) sulfur were prepared.

The moisture content of the coal product was reduced to essentially zero by vacuum drying at 65° C. for 16 hours.

EXAMPLES

Our research has shown that heating certain coals, especially the subbituminous western coals, in aqueous sodium hydroxide solutions at elevated temperatures of about 250° C. and the corresponding steam pressure of about 600 psig resulted in solubilization of 85 to 90 percent of the coal. Much of the ash and some of the coal remained as an insoluble residue. Neutralization of the resulting coal solution with carbon dioxide to a pH of about 8 resulted in the precipitation of a finely divided coal product. Analysis of this coal product revealed that it contained, in addition to the solubilized coal, a portion of the inorganic materials such as aluminum- and silicon-containing compounds. The ash content in other coals was converted to acid-soluble form during pressure leaching of the coals with sodium hyroxide solutions.

In the present study, a subbituminous coal from the Colstrip mine in Montana was treated. Analysis of the particular sample of coal is shown below:

$H_2O$, % — 21.8
Ash, % — 8.56
Total Sulfur, % (MAF) — 1.01
Organic, % (MAF) — 0.76
Heat content, Btu/lb (MAF) — 12,310

Previous work has shown that this coal was subject to solubilization (depolymerization) in 10 percent sodium hydroxide solutions.

As shown in the drawing, and as described below, a typical method according to the present invention may be considered to comprise four main steps.

Preparation of Coal Solutions

The first processing step was intended to maximize dissolution of the coal and minimize dissolution of the ash or inorganic portion of the coal. Efforts were made to achieve the objective by heating an aqueous alkaline slurry of the coal over the following range of processing parameters:

(1) NaOH/coal ratio — 0.5 to 0.7
(2) $H_2O$/coal ratio — 5
(3) Leaching temperature, C — 270 to 315
(4) Leaching time, minutes — 30 to 120

A typical experiment entailed:

(1) Mixing 300 g of Colstrip coal, ground to about 70 percent minus 200 mesh, in 1500 ml of a 10 percent aqueous sodium hydroxide solution
(2) Sealing the resulting slurry in an autoclave
(3) Purging the autoclave with nitrogen
(4) Heating the slurry at 315° C. for 30 minutes
(5) Separating the coal solution from the insoluble residue by pressure filtration at 315° C.
(6) Cooling the autoclave to about 90° C.
(7) Removing the insoluble residue and washing it with water.
(8) Vacuum drying the insoluble residue at 65° C.

Separation of Coal From Solubilized Ash

The next processing step aimed to selectively precipitate the coal value from the coal solution while leaving as much of the ash in solution as possible. Efforts were made to achieve this objective by partial or complete neutralization of the coal solution with a variety of acids. Included in this list are (1) carbonic, (2) sulfuric, (3) hydrochloric, (4) formic, and (5) acetic acids.

Normally, separation of the coal from the coal solution and the solubilized ash was conducted accordingly:

(1) Heat the coal solution to 60° to 80° C. Attempts to precipitate the coal at ambient temperature resulted in the formation of a thioxotropic mixture at a pH of about 9. The precipitated coal was difficult to separate from this thixotropic mixture by filtration or centrifugation.

(2) Adjust the pH of the solution to less than or equal to 8 to 9 by the addition of one of the acids noted above. It was necessary to lower the pH to at least 8 to 9 in order to precipitate the coal and to destroy the thixotropic behavior of the slurry. In some experiments, precipitation of the coal product and deashing were combined into one operation. In these cases, the pH was lowered gradually to about 2 using, for example, sulfuric or formic acid. With carbonic acid, the pH was lowered to 8.5 to 8.9.

(3) Separate the precipitate coal from the slurry by filtration.

(4) Separate residual solution from the coal product by a series of washing/filtration operations. Washing was conducted by slurrying the product from (2) in water heated to 25° or 60° C. for 30 minutes.

(5) Vacuum dry the coal product at 25° or 65° C. or perform the deashing operation.

by the standard ASTM wet chemical methods. Particle size was determined by the electron scanning microscope and heat content was determined by the standard bomb calorimetric method.

Extraction of Coal Values

As shown in Table 1, Colstrip coal (a subbituminous B coal) is subject to dissolution by pressure leaching in aqueous sodium hydroxide solutions. From these data, several observations were made:

(1) Degree of coal solubilization appears to pass through a maximum at about 270° C. At this temperature, approximately 94 percent of the coal was solubilized in 90

TABLE 1.

DISSOLUTION OF COAL

| | Processing Conditions | | | | Analysis of Solid Residue | | | | Degree of Dissolution | | |
|---|---|---|---|---|---|---|---|---|---|---|---|
| Run No. | $H_2O$/Coal Ratio | NaOH/Coal Ratio | Temp, C | Time, min | $H_2O$ % | Ash, % | S, % | N, % | Coal | Ash Dissolution, % | Sulfur Dissolution, % |
| Raw Coal | | | | | 21.8 | 8.56 | 0.71 | 0.78 | | | |
| 1 | 5 | 0.5 | 270 | 90 | 1.28 | 40.9 | 0.16 | 0.48 | 93.7 | 63.4 | 97.0 |
| 2 | 5 | 0.5 | 225 | 120 | 2.80 | 36.3 | 0.22 | —84.8 | 26.5 | 94.6 | |
| 4 | 5 | 0.7 | 270 | 60 | 2.96 | 38.3 | 0.17 | — | 89.3 | 43.5 | 95.8 |
| 5 | 5 | 0.5 | 315 | 120 | 21.3 | 30.1 | 0.13 | 0.48 | 79.0 | −11.4[a] | 93.9 |
| 6 | 5 | 0.5 | 315 | 30 | 1.41 | 39.4 | 0.15 | 0.53 | 87.0 | 29.5 | 96.8 |
| 7 | 5 | 0.5 | 315 | 30 | 19.8 | 30.6 | 0.13 | — | 85.1 | 24.9 | 96.2 |
| 8 | 5 | 0.5 | 315 | 30 | | | | | | | |

Means greater than 100% solubilization.

Deashing of the Coal Product

The next processing step was designed to lower the ash content of the coal product to as low as possible by acid leaching. Acids used in this operation were sulfuric, hydrochloric, acetic, and formic.

Deashing was carried out as a separate operation on those coal products which had been precipitated from the coal solutions with carbonic acid ($CO_2$). This operation entailed:

(1) Slurrying the coal product from (4) above in sufficient acid to produce a slurry having a pH of 1 to 3. Normally, this was carried out at ambient temperature in an effort to prevent hydrolysis of silica values.

(2) Separating the deashed coal from the slurry by filtration.

(3) Separating the residual solution from the coal product by a series of washing/filtration operations. In most experiments, the product from 200 ml of coal solution was washed 3 to 4 times in 200 to 400 ml of water.

Drying of Coal Product

Because of the potential high reactive nature of the coal product with oxygen, all products were dried in a vacuum oven at 25° to 65° C. for about 16 hours. Drying may also be carried out in an inert atmosphere at atmosphere pressure. For some applications, removal of the water is not required. For example, the product may be mixed directly with oil to form an oil slurry; or the majority of the water may be removed during a briquetting operation, with or without the addition of a binder, to produce briquets for stoker furnaces; or the product may be burned wet.

Characterization of Coal Product

The coal product was characterized in terms of (1) purity, which included water, ash, sulfur, nitrogen and, in some cases, carbon contents, (2) particle size, and (3) heat content of selected samples. Purity was determined minutes. Increasing the temperature to 315° C. for 30 minutes resulted in a decrease in the degree of dissolution to about 89 percent. At 315° C. for 120 minutes, 79 percent of the coal was dissolved. At 225° C. for 120 minutes, degree of dissolution was about 85 percent. Examples of other coals that are highly soluble include (1) Dave Johnston (a subbituminous C coal), and (2) Illinois No. 6 and Illinois No. 5 (bituminous coals). An example of a lignite is Lignite A from the Savage Mine in Richland County, Montana.

(2) Likewise, dissolution of the ash was maximized at a temperature of about 270° C. At temperatures of 225° and 315° C., degree of ash dissolution was about 25 percent.

(3) Degree of sulfur extraction is less sensitive to temperature and leaching time. In all experiments, greater than about 94 percent of the sulfur was dissolved.

From these data, it is concluded:

(1) Subbituminous coals such as the Colstrip coal can be dissolved or at least converted to a form which remains suspended in an aqueous sodium hydroxide solution at a pH of about 13. Most likely, the coal is depolymerized by the action of the sodium hydroxide on the coal molecule and the "coal solution" is a colloidal suspension rather than a true solution. During the pressure leaching, phenolic or carboxylic groups on the coal are converted to the corresponding sodium salts. Heating these solutions at temperatures greater than about 270° C. apparently results in decarboxylation of the coal to produce a material which is less "soluble" in the aqueous caustic solution. From these data, the near-optimum temperature for maximum solubilization of Colstrip coal is about 270° C. at a water to coal ratio of 5 and a NaHO to coal ratio of 0.5.

(2) Coal ash is very soluble in sodium hydroxide at 270° C. However, at higher temperatures, the solubility is reversed, possibly due to the formation and precipitation of insoluble sodium aluminum silicates or hydrolysis of the sodium silicates which results in the precipitation of silica.

(3) Most of the sulfur present in the Colstrip coal is soluble in aqueous sodium hydroxide. In fact, the degree of sulfur extraction was higher in all experiments than the degree of coal dissolution. Similar results have been obtained in other work in chemical desulfurization of coal.

Recovery of Coal Product

A coal product can be precipitated from the coal solutions by neutralization of the solutions with a variety of inorganic and organic acids. It was observed that the coal product began to precipitate at a pH of about 10. At a pH of about 8 to 9, precipitation of the coal appeared to be complete. If stepwise neutralization was conducted at about 25° C., the coal product was recoverable from the slurry by filtration or centrifugation with difficulty because of the thixotropic nature of the slurry. Precipitating the coal at temperatures of 60° C. or higher produced a more readily filterable product. At a temperature of 60° C., some thickening of the slurry was observed at a pH of 9 to 10. As the pH of the slurry was lowered, the slurry passed through the thixotropic stage at a pH between 8 and 9. At this pH, the coal product could be recovered easily by filtration. At 80° C., the slurry passed through the thixotropic stage very rapidly. Thus, the near-optimum temperature for precipitating the coal by stepwise neutralization from the coal solutions is about 60° C. or higher. The thixotropic problem was significantly reduced by combining precipitation of the coal and deashing into one operation as in Experiment 32537-12.

Characterization of Coal Products

Analysis of the coal products in terms of water, ash, and total sulfur contents for all samples prepared and carbon content and heat value of selected samples are shown in Table 2. These data indicate that reconstitution is a useful method for the production of low-ash, low-sulfur coal.

Ash Content

Ash content of the coal was found to be dependent on pH as noted in Experiments 32537-21-14, -22-10, and -23-10. Precipitation of the coal at pH values of 9, 5, and 1.5 (one step process) resulted in products containing 8.73, 5.23, and 0.89 percent (MAF), respectively. Similar results were achieved as noted in Experiments 32537-12, -62, and -63 (two step process). In these experiments, the ash content was lowered to about 0.5 percent (MAF).

TABLE 2.

RECOVERY AND ANALYSIS OF COAL PRODUCT

| Experiment No. 32537- | Source of Coal Solution | Conditions for Precipitation of Coal: Acid | pH | Temp, C | Deashing Conditions: Acid | Temp, C | pH | Washing Temp, C | Analysis of Coal Product: Wt, g | $H_2O$, % | Ash, % | Total Sulfur % | Heat Content, Btu/lb (MAF) |
|---|---|---|---|---|---|---|---|---|---|---|---|---|---|
| Raw Coal | | | | | | | | | — | 21.8 | 18.56 (12.3)[a] | 0.71 (1.01) | (12,309) |
| -12 | 32537-1 | $H_2SO_4$ | 1.5 | 25 | $H_2SO_4$ | 25 | 1.5 | 25 | 16 (15.6) | 2.06 — | 0.46 (0.47) | 0.77 (0.79) | (13,568) |
| -62 | 32537-6 | $CO_2$ | 8.9 | 80 | $H_2SO_4$ | 60 | 2 | 25 | 52 (16.0) | 69.0 — | 0.48 (0.61) | 0.21 (0.68) | |
| -63 | 32537-6 | $CO_2$ | 8.9 | 80 | $H_2SO_4$ | 60 | 2 | 60 | 42 (9.5) | 77.2 — | 0.10 (0.44) | 0.15 (0.67) | (13,700) |
| -64 | 32537-6 | $CO_2$ | 8.5 | 60 | Acetic | 25 | 3 | 25 | 18 (12.8) | 27.3 — | 1.57 (2.20) | 0.46 (0.57) | |
| -71 | 32537-7 | $CO_2$ | 8.5 | 60 | Hcl | 25 | ~1 | 25 | 10 (9.6) | 1.98 — | 1.51 (1.56) | 0.53 (0.55) | |
| -72 | 32537-7 | $CO_2$ | 8.5 | 60 | Formic | 25 | 2.5 | 25 | 15 (14.5) | 2.29 — | 1.05 (1.09) | 0.35 (0.36) | (14,250) |
| -73 | 32537-7 | $CO_2$ | 8.5 | 60 | $H_2SO_4$ | 25 | 1.5 | 25 | 21 (20.5) | 1.42 — | 1.02 (1.04) | 0.60 (0.62) | (14,043) |
| -74 | 32537-7 | $CO_2$ | 8.5 | 60 | Water washed | ~7 | 25 | 10.0 | 2.06 (9.1) | 6.85 — | 0.33 (7.52) | (0.36) | |
| -81 | 32537-8 | Formic | 8 | 60 | Water washed | ~7 | 25 | 14 | 22.7 (10.5) | 2.41 — | 0.33 (3.22) | (0.44) | |
| -82 | 32537-8 | Formic | 2 | 60 | Water washed | | ~7 | 25 | 21 (13.23) | 36.4 — | 0.34 (0.53) | 0.33 (0.52) | |
| 21- | 32537-7 | $H_2SO_4$ | 1.5 | 80 | Water washed | | ~7 | 25 | 11.2 (11.1) | 0 — | 0.88 (0.89) | 0.40 (0.40) | |
| 22-10 | 32537-7 | $H_2SO_4$ | 9 | 80 | Water washed | | ~7 | 25 | 10.7 (9.6) | 2.90 — | 7.80 (8.73) | 0.30 (0.34) | |
| 23-10 | 32537-7 | $H_2SO_4$ | 5 | 80 | Water washed | | ~7 | 25 | 12.5 (11.9) | 0.09 — | 4.97 (5.23) | 0.45 (0.47) | |

[a]Data in parenthesis are on moisture-ash free basis.

This ash was found to be composed of primarily $SiO_2$ along with minor concentrations of iron, titanium, and barium compounds, probably oxides, as shown in Table 3. The concentration of other metal values was negligible.

TABLE 3.

OPTICAL EMISSION SPECTROGRAPHIC ANALYSES OF SELECTED COAL PRODUCTS (% AS METAL)[a]

| Sample No. 32537 | Si | Fe | Ti | Ba | Mg | Al | Mo | Cu | Ni | Ca |
|---|---|---|---|---|---|---|---|---|---|---|
| 12 | 0.1 | 0.01 | 0.01 | 0.01 | T <0.005 | T <0.005 | 0.02 | <0.005 | <0.005 | <0.005 |
| 62 | 0.2 | 0.01 | 0.03 | 0.01 | T <0.005 | T <0.005 | <0.005 | <0.005 | T <0.005 | T <0.005 |

TABLE 3.-continued

OPTICAL EMISSION SPECTROGRAPHIC ANALYSES OF SELECTED COAL PRODUCTS (% AS METAL)[a]

| Sample No. 32537 | Si | Fe | Ti | Ba | Mg | Al | Mo | Cu | Ni | Ca |
|---|---|---|---|---|---|---|---|---|---|---|
| 63 | 0.2 | 0.01 | 0.03 | 0.01 | <0.005 | <0.005 | <0.005 | <0.005 | <0.005 | <0.005 |

[a]Other impurities sought, but not found.

Reduction in the silica content of the coal product below the 0.1% level may be achieved by further development or fine tuning of the process. For example, in most of these experiments, there was significant time lapse between the time the coal product was precipitated and separated from the primary filtrate. During this time, hydrolysis of the siliceous acid could have occurred. Also, siliceous acid in unstable in aqueous solutions at elevated temperatures and low pH values and tends to hydrolyze to silica. This could have occurred even during precipitation of the coal from the coal solution. Therefore, it may be necessary, in some instances, to separate the silica from the coal solution before precipitation of the coal product or even to take steps to prevent solubilization of the silica during the preparation of the coal solutions. This may be done by the addition of lime in one or both processing steps to precipitate the silica as insoluble calcium silicate or calcium aluminum silicates.

Sulfur Content

As shown in Table 2, low-sulfur coal, i.e., coal containing 0.4 to 0.5 percent sulfur (MAF) was recovered from the Colstrip coal by the reconstitution process. Further reduction in the sulfur level may be possible with coals containing lower concentrations of organic sulfur. The raw coal contained 0.76 percent organic sulfur (MAF), (Organic sulfur content of raw coal based on breakdown in sulfur forms from Experiment 32537-12 (Table 2).)

Sulfur content of the coal product appears to be more dependent on the processing conditions by which the coal solutions were prepared than on the method employed for recovering the coal from the coal solutions. For example, as noted in Table 2, Experiment 32537-12, the coal product contained 0.79 percent sulfur (MAF). (Raw coal contained 1.01 percent sulfur on MAF basis). In this case, the coal solution was prepared by heating the coal in a 10 percent sodium hydroxide solution at 270° C. for 90 minutes. On the other hand, a coal product (Experiment 32537-21-14) containing 0.40 percent sulfur (MAF) was recovered from a coal solution prepared by heating a similar solution at 315° C. for 30 minutes. In both experiments, sulfuric acid was used to precipitate and deash the coal product. The final pH was 1.5, and the coal product was washed with water at 25° C. until a negative test for soluble sulfate was obtained. In Experiment 32537-12, the coal product was precipitated at 25° C., whereas in Experiment 32537-21-14, precipitation was conducted at 80°C. The different precipitation temperatures should not have any significant effect on the sulfur content of the coal.

The only plausible explanation at this time is that the "organic sulfur" was converted to a sodium hydroxide soluble form at the higher leaching temperature. A breakdown in the total sulfur was not obtained on the coal product precipitate from the solution prepared at 315° C.; however, analysis of that precipitated from the solution prepared at 270° C. indicated that 99 percent of the total sulfur was organic. The remainder was sulfate sulfur. From this, it is inferred that the sulfur remaining in the treated coal is organic sulfur. If this be the case, then sodium hydroxide is definitely attacking the organic sulfur, converting it to a form(s) which is (are) soluble in aqueous solutions over a wide pH range or which is volatilized as $H_2S$ during pH adjustment.

Data on selective separation of the treated coal by first treating the coal solution with $CO_2$, followed by treatment with acid to remove residual ash precipitated with the coal are shown in Table. These data indicate that a portion of ash is coprecipitated with the treated coal. For example, the treated coal from Experiment 32537-74 contained 7.52 percent ash (MAF). In this experiment, the treated coal, precipitated with $CO_2$ at a pH of 8.5 and 60° C., was washed with water at 25° C.

Several acids were investigated as candidates for removing the ash from the $CO_2$-precipitated coal. Of those tested—sulfuric, acetic, hydrochloric, and formic acid—sulfuric acid was the most effective in lowering the residual ash concentration.

Heat Content

The heat content of selected samples of coal products and raw coals is shown in Table 3. From these data, it is observed that the heat content of the coal products is significantly higher (approximately 10–16 percent) on a MAF basis than that of the raw coal. This may be the result of some degree of coalification which occurred during the pressure leaching operation.

Reactivity

Hydrothermal dissolution of coal results in depolymerization of the coal molecule to produce a material of significantly higher reactivity toward liquefaction than the raw coal. The liquefaction of the material by heating it with anthracene, for example, is more readily attainable.

Particle Size

Particle size determinations were made on the samples without ultrasonically dispersing them. Careful examination of the resulting microphotographs appeared to reveal that the coal product consisted of particles in the range of 1 to 10 microns. Even these particles may represent agglomerates. The particles appeared to have no definite particle shape. Some appeared to be platelets; others had round edges and looked like "balls".

Moisture Content

Routine testing is required to determine optimum conditions for drying different coal products. Our tests showed that it was possible to reduce the water content of the wet filter cake to essentially zero by vacuum drying at 65° C. for about 16 hours (Experiment 32537-21-14, Table 2). Many of the other coal products contained about 2 percent water. Those shown in Table 2 which contain high concentration of water were either vacuum dried at 25° C. or at 65° C. under low vacuum.

Yield of Coal Product

Yield of coal product varied widely from one experiment to another; however, it is believed that much of this variation is due to physical losses. It is estimated that yield of coal product attainable at this stage of development is about 65 percent (MAF). This is based on the results from Experiment 32537-62, Table 2, which was conducted particularly carefully to minimize physical losses. In this experiment, 89 percent of the coal was solubilized to produce a solution containing about 123 g/l of coal (MAF). The yield of coal product from 200 ml of the coal solution was 16.0 g (MAF), assuming no physical loss. This represents a yield of 65 percent.

The composition and physical properties of coals and lignites may vary widely, each one possibly presenting its special problem, and it is of course impossible to specify beforehand the precise treatment that would be most successful and economical in each case. When different materials are treated, preliminary tests should be made to determine the most suitable concentrations, times, temperatures, etc. in the various steps to obtain the desired results.

While the forms of the invention herein disclosed constitute presently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

I claim:

1. A method of treating a solid carbonaceous material comprising essentially lignite or bituminous or subbituminous coal to provide therefrom finely dispersed solid particles substantially free of ash and sulfur, comprising
   - mixing the solid material with a liquid aqueous alkaline solution comprising essentially a sodium, potassium, or ammonium hydroxide, hydrosulfide, or carbonate, or a plurality thereof,
   - dissolving the material by heating the resulting mixture to a temperature in the range of about 125° C to the critical temperature, at a pressure of at least about 25 psig, while maintaining a substantial portion of the mixture in the liquid state,
   - separating from the resulting solution any undissolved coal, ash, and other solids,
   - reducing the pH of the solution to less than about 9 to precipitate therefrom a powder comprising the carbonaceous material, with a substantial proportion of the ash and sulfur that had been in the starting material now remaining in solution, and
   - separating the precipitated powder from the solution.

2. A method as in claim 1, wherein the undissolved coal, ash, and other solids are separated from the solution by filtering at elevated temperature and pressure.

3. A method as in claim 1, wherein silica is precipitated from the solution by adding calcium oxide or calcium hydroxide thereto, before reducing the pH.

4. A method as in claim 1, wherein the temperature of the solution is about 25° to 150° C. during the pH reducing step.

5. A method as in claim 1, wherein the pH is reduced by sparging the solution with carbon dioxide.

6. A method as in claim 1, wherein the pH is reduced by adding an acid to the solution.

7. A method as in claim 1, wherein the pH is reduced by adding formic, acetic, sulfuric, or hydrochloric acid to the solution.

8. A method as in claim 1, wherein the pH of the solution is gradually reduced to less than about 2 during a time of at least about 5 minutes.

9. A method as in claim 1, wherein the temperature of the solution is about 60° to 80° C. during the pH reducing step, and comprising also washing the precipitated powder with an acid solution having a pH of less than about 2.

10. A method as in claim 9, wherein the precipitated powder is washed with formic, acetic, sulfuric, or hydrochloric acid.

11. A method as in claim 9, comprising mixing the precipitated powder with water and sparging the resulting slurry with sulfur dioxide or sulfur trioxide.

12. A method as in claim 9, wherein the precipitated powder is washed by mixing it with water and heating the mixture to a temperature of about 175° to 275° C., at a pressure of at least about 75 psig that is provided in part by carbon monoxide or carbon monoxide and hydrogen.

13. A method as in claim 1, wherein the aqueous solution comprises also sodium, potassium, or ammonium sulfide.

14. A method as in claim 1, wherein the solution separated from the precipitated powder is regenerated for recycling.

15. A method as in claim 1, comprising also drying the precipitated powder to provide a powdered fuel usable in combustion engines, furnaces, or other combustion devices.

16. A method as in claim 1, comprising also mixing the precipitated powder with a carbonaceous liquid to provide a liquid fuel usable in combustion engines, furnaces, or other combustion devices.

17. A method as in claim 1, wherein the precipitated powder is liquefied by mixing with a liquid carbonaceous material; heating the mixture to a temperature in the range of about 250° C. to the critical temperature, a pressure of at least about 100 psig, provided in part by carbon monoxide or carbon monoxide and hydrogen; and separating the liquid product from any unreacted solids; the liquid product providing a fuel usable in combustion engines, furnaces, or other combustion devices.

18. A method as in claim 17, wherein the carbonaceous material comprises essentially the separated liquid product recycled from earlier liquefaction of the precipitated powder as in claim 17.

19. A method as in claim 1, comprising also compressing the precipitated powder into pieces usable as briquets for burning in furnaces and other combustion devices or as electrodes.

* * * * *